US010307028B2

(12) United States Patent
Gray

(10) Patent No.: US 10,307,028 B2
(45) Date of Patent: Jun. 4, 2019

(54) CLEANER HEAD FOR A VACUUM CLEANER

(71) Applicant: Dyson Technology Limited, Wiltshire (GB)

(72) Inventor: Jonathan James Gray, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 15/427,454

(22) Filed: Feb. 8, 2017

(65) Prior Publication Data

US 2017/0231449 A1 Aug. 17, 2017

(30) Foreign Application Priority Data

Feb. 12, 2016 (GB) ..... 1602546.2

(51) Int. Cl.
*A47L 9/06* (2006.01)

(52) U.S. Cl.
CPC ..... *A47L 9/0633* (2013.01); *A47L 9/0666* (2013.01)

(58) Field of Classification Search
CPC ..... A47L 9/0633; A47L 9/0666; A47L 9/02; A47L 9/242; A47L 9/06
See application file for complete search history.

(56) References Cited

U.S. PATENT DOCUMENTS 2,517,058 A 8/1950 Uber
2,659,925 A 11/1953 Wood
3,837,038 A 9/1974 Kimzey et al.
5,077,863 A 1/1992 Rench
5,301,387 A * 4/1994 Thomas ..... A47L 11/30 15/322
5,400,467 A * 3/1995 Hwang ..... A47L 9/04 15/322
5,819,366 A * 10/1998 Edin ..... A47L 7/0009 15/322

(Continued)

FOREIGN PATENT DOCUMENTS

DE 1 960 386 5/1967
DE 10301113 A1 * 9/2003 ..... A47L 9/02

(Continued)

OTHER PUBLICATIONS

European Search Report dated Jul. 6, 2017, directed to EP Application No. 17 15 1506; 2 pages.

(Continued)

*Primary Examiner* — Dung Van Nguyen
(74) *Attorney, Agent, or Firm* — Morrison & Foerster LLP

(57) ABSTRACT

A cleaner head for a vacuum cleaner having a suction inlet, a front blade and a rear blade. The front blade is located forward of or at the front of the suction inlet and is arranged to pivot about a first axis. The rear blade is located rearward of or at the rear of the suction inlet and is arranged to pivot about a second axis different to the first axis. Each blade pivots between a deployed position and a retracted position. The blades are configured such that when one of the blades is in the deployed position, the other of the blades is in the retracted position. Additionally, when one of the blades moves from the deployed position to the retracted position, the other of the blades moves from the retracted position to the deployed position.

30 Claims, 5 Drawing Sheets

(56) References Cited

U.S. PATENT DOCUMENTS

| | | | | |
|---|---|---|---|---|
| 6,647,585 | B1 * | 11/2003 | Robinson | A47L 9/02 15/322 |
| 2008/0120801 | A1 | 5/2008 | Kim et al. | |
| 2008/0301901 | A1 | 12/2008 | Oh | |
| 2013/0145577 | A1 | 6/2013 | Davidshofer et al. | |
| 2015/0059123 | A1 | 3/2015 | Kasper | |

FOREIGN PATENT DOCUMENTS

| | | |
|---|---|---|
| EP | 0 200 957 | 12/1986 |
| EP | 0 780 084 | 6/1997 |
| EP | 1 173 085 | 1/2002 |
| EP | 1 369 074 | 12/2003 |
| EP | 2 910 168 | 8/2015 |
| EP | 3 025 626 | 6/2016 |
| GB | 2 109 224 | 6/1983 |
| JP | 62-112558 | 7/1987 |
| JP | 2001-145594 | 5/2001 |
| JP | 2004-350763 | 12/2004 |
| KR | 10-0652488 | 12/2006 |

OTHER PUBLICATIONS

Search Report dated Jul. 15, 2016, directed to GB Application No. 1602546.2; 1 page.

* cited by examiner

CLEANER HEAD FOR A VACUUM CLEANER

REFERENCE TO RELATED APPLICATION

This application claims the priority of United Kingdom Application No. 1602546.2, filed Feb. 12, 2016, the entire contents of which are incorporated herein by reference.

FIELD OF THE INVENTION

The present invention relates to a cleaner head for a vacuum cleaner.

BACKGROUND OF THE INVENTION

FIGS. 1 to 3 illustrate a known cleaner head 1 for a vacuum cleaner. The base of the cleaner head 1 comprises a suction inlet 2, a front plate 3 located forward of the suction inlet 2, and a rear plate 4 located rearward of the suction inlet 2. Each of the two plates 3,4 is inclined or ramped relative to the horizontal. When the cleaner head 1 is placed onto a carpeted surface, the two plates 3,4 penetrate the piles of the carpet. As a result, the air that is drawn into the suction inlet 2, which passes beneath each of the plates 3,4, penetrates more deeply into the carpet. When the cleaner head 1 is pushed forwards, the ramped surface of the front plate 3 helps to flatten the piles of the carpet. As a result, the front plate 3 moves relatively smoothly over the piles of the carpet. The rear plate 4, on the other hand, presents a vertical surface to the piles and therefore tends to dig into the piles. As a result, a greater push force is required in order to manoeuvre the cleaner head 1 forwards. Moreover, as the cleaner head 1 is pushed forwards, the cleaner head 1 may skip over the carpet as the rear plate 4 first digs into the piles and then, with sufficient push force, jumps clear of the piles. Skipping of the cleaner head 1 is likely to worsen the cleaning performance since the cleaner head 1 is momentarily lifted from the carpet. The same behaviour is observed when the cleaner head 1 is pulled rearwards.

SUMMARY OF THE INVENTION

According to certain aspects, the present invention provides a cleaner head for a vacuum cleaner comprising: a suction inlet; a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, each blade projects downwardly when in the deployed position, and the blades are coupled together such that (i) when one of the blades is in the deployed position the other of the blades is in the retracted position, and (ii) moving one of the blades from the deployed position to the retracted position causes the other of the blades to move from the retracted position to the deployed position.

Each blade projects downwardly when in the deployed position. Consequently, when used on a carpeted surface, the deployed blade penetrates the piles of the carpet. Air drawn into the suction inlet via the deployed blade then penetrates deeply into the carpet. The blades are coupled together such that, when one of the blades is in the deployed position, the other of the blades is in the retracted position. Consequently, when the cleaner head is manoeuvred forwards or rearwards, only one of the blades is deployed at any one time. As a result, the cleaner head is easier to manoeuvre and is less likely to skip over the carpeted surface. Since only one blade is deployed at any one time, it is possible to employ blades that penetrate more deeply into the carpet. By contrast, if the plates of the cleaner head of FIGS. 1 to 3 were to penetrate more deeply into the carpet, the force required to manoeuvre the cleaner head may become excessive and/or skipping of the cleaner head may become frequent. In addition to improving the manoeuvrability of the cleaner head, each blade may help to create a partial seal between the cleaner head and the carpet when in the retracted position. As a result, more of the air drawn into the suction inlet occurs at the deployed blade, thus improving the cleaning performance.

The front blade may move to the deployed position when the cleaner head is manoeuvred forwards, and the rear blade may move to the deployed position when the cleaner head is manoeuvred rearwards. Moreover, when the direction of travel of the cleaner head over a cleaning surface (such as a carpeted surface) is reversed, the cleaning surface may apply a force to the deployed blade that causes the deployed blade to move towards the retracted position. As a consequence of the coupling between the blades, the retracted blade in turn moves towards the deployed position. As the retracted blade moves towards the deployed position, the cleaning surface may apply a force to the retracted blade that causes the retracted blade to move fully to the deployed position. The blades of the cleaner head thus move automatically between the deployed and retracted positions as the cleaner head is manoeuvred forwards and rearwards. This then has the advantage that a user is not required to adjust the setting of the cleaner head for forward or rearward movement.

When in the deployed position, the front blade may have a ramped front-facing surface and the rear blade may have a ramped rear-facing surface. This then has the advantage that, as the cleaner head is manoeuvred forwards and rearwards over a carpeted surface, the deployed blade is able to deflect and flatten the piles of the carpet. As a result, the deployed blade is able to move relatively smoothly over the piles.

When in the deployed position, the front blade may have a vertical rear-facing surface and the rear blade may have a vertical front-facing surface. This then has the benefit that a relatively poor seal is formed between the deployed blade and the cleaning surface. Consequently, more of the air drawn into the suction inlet occurs at the deployed blade. Furthermore, dirt-laden air drawn beneath the deployed blade may have a relatively clear path to the suction inlet and thus dirt carried by the air is less likely to be deposited back onto the cleaning surface.

When in the retracted position, the rear-facing surface of the front blade and the front-facing surface of the rear blade may be horizontal. As a result, a partial seal may be created between the horizontal surface of the retracted blade and the cleaning surface. This then has the benefit that less air is drawn into the suction inlet via the retracted blade and thus more air is drawn into the suction inlet via the deployed blade, where it is most desired.

The cleaner head may comprise a planar front plate located forward of the front blade and a planar rear plate located rearward of the rear blade. The front blade then projects downwardly beyond plane of the front plate when in the deployed position, and the rear blade projects downwardly beyond the plane of the rear plate when in the deployed position. When the cleaner head is manoeuvred forwards over a carpeted surface, the rear plate may sit on top of and gently crush the piles of the carpet so as to form a partial seal. Equally, when the cleaner head is manoeuvred rearwards, the front plate may sit on top of and gently crush the piles of the carpet so as to form a partial seal. This then has the benefit that less air is drawn into the suction inlet via the retracted blade and thus more air is drawn into the suction inlet via the deployed blade. The deployed blade projects downwardly beyond the corresponding plate. As a result, the corresponding plate does not adversely affect the flow of air that is drawn into the suction opening via the deployed blade, i.e. the front plate does not adversely affect the flow of air beneath the front blade during forward movement, and the rear plate does not adversely affect the flow of air beneath the rear blade during rearward movement.

The front blade may be flush with the front plate when in the retracted position, and the rear blade may be flush with the rear plate when in the retracted position. This then has the advantage that each blade, when in the retracted position, contributes to the partial seal that is formed between the cleaner head and the cleaning surface. As a result, a more effective seal may be achieved.

The front blade may pivot forward and the rear blade may pivot rearward when moving from the deployed position to the retracted position. This then has the benefit that the size of the suction inlet is unchanged by the movement of the blades, and thus the same cleaning performance may be achieved in both forward and rearward directions.

The front and rear blades may be coupled together by a bracket that is attached to each blade. More particularly, the bracket may comprise two arms and a bridge. One arm is then fixedly attached at one end to the front blade, and is pivotally attached at the opposite end to the bridge. The other arm is then fixedly attached at one end to the rear blade, and is pivotally attached at the opposite end to the bridge. The use of a bracket to couple the blades, particularly the one described here, provides a relatively simple arrangement for ensuring that, as one blade moves from the deployed position to the retracted position, the other blade is caused to move from the retracted position to the deployed position.

According to certain aspects, the present invention also provides a cleaner head for a vacuum cleaner comprising: a suction inlet; a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, each blade projects downwardly when in the deployed position, and moving the cleaner head over a cleaning surface in a forward direction causes the front blade to move to the deployed position and the rear blade to move to the retracted position, and moving the cleaner head over the cleaning surface in a rearward direction causes the rear blade to move to the deployed position and the front blade to move to the retracted position.

According to certain aspects, the present invention further provides a cleaner head for a vacuum cleaner comprising: a suction inlet; a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, the blades are configured such that when one of the blades is in the deployed position the other of the blades is in the retracted position, and, when in the deployed position, the front blade has a ramped front-facing surface and the rear blade has a ramped rear-facing surface.

According to certain aspects, the present invention additionally provides a cleaner head for a vacuum cleaner comprising: a main body having a suction inlet located in a base of the main body; a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, the blades are configured such that when one of the blades is in the deployed position the other of the blades is in the retracted position, each blade projects downwardly beyond the base of the main body when in the deployed position, and each blade is flush with the base of the main body when in the retracted position.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
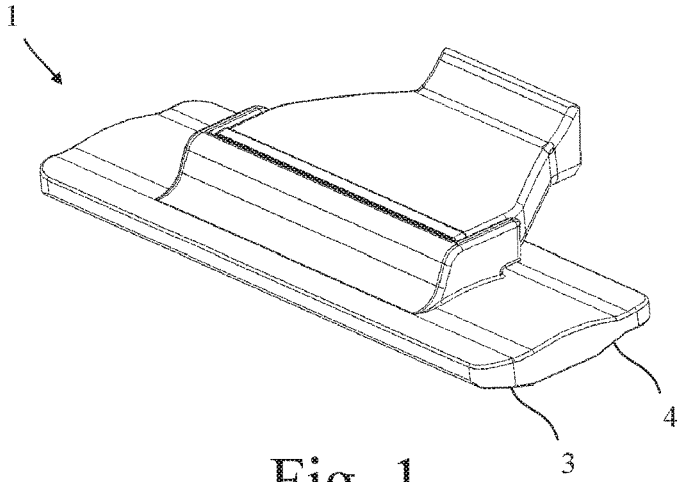
Fig. 1 (Prior Art)
FIG. 1 is a perspective view of a known cleaner head.

The cleaner head 10 of FIGS. 4 to 8 comprises a main body 11, a front blade 12, a rear blade 13, a pair of brackets 14 and a pair of covers 15.

The main body 11 comprises a suction inlet 20 located in the base of the main body 11. The suction inlet 20 is rectangular in shape and opens into a suction cavity 21 located above the suction inlet 20. The main body 11 comprises a neck-like portion 18 for attachment to a vacuum cleaner (not shown). A channel 22 extends through the neck-like portion 18 from the suction cavity 21 to a suction outlet 23 located at the end of the neck-like portion 18. During use, suction applied at the suction outlet 23 by the vacuum cleaner causes dirt-laden air to be drawn into the suction cavity 21 via the suction inlet 20. From there, the dirt-laden air is carried to the vacuum cleaner via the channel 22.

The base of the main body 11 comprises a front plate 30 located forward of the suction inlet 20 and a rear plate 31 located rearward of the suction inlet 20. Each of the plates 30,31 is planar and extends horizontally.

The front and rear blades 12,13 are located within the suction cavity 21, with the front blade 12 located at the front of the suction cavity 21 and the rear blade 13 located at the rear of the suction cavity 21. Each blade 12,13 comprises an elongate body 40 and a pair of pivot pins 41. The front blade 12 additionally comprises a stop arm 42. The body 40 of each blade 12,13 has a cross-sectional shape that resembles a teardrop. Consequently, the body 40 may be regarded as having a cylindrical portion and a triangular or prismatic portion. The pivot pins 41 extend outwardly from the ends of the body 40. The stop arm 42 of the front blade 12 extends outwardly along the length of the body 40.

The pivot pins 41 of each blade 12,13 are received within corresponding holes 19 in the side walls of the main body 11 of the cleaner head 10. As a result, each blade 12,13 is pivotally attached to the main body 11. The front blade 12 pivots about a first axis 43, and the rear blade 13 pivots about a second axis 44 that is different but parallel to the first axis 43.

Figure 7:
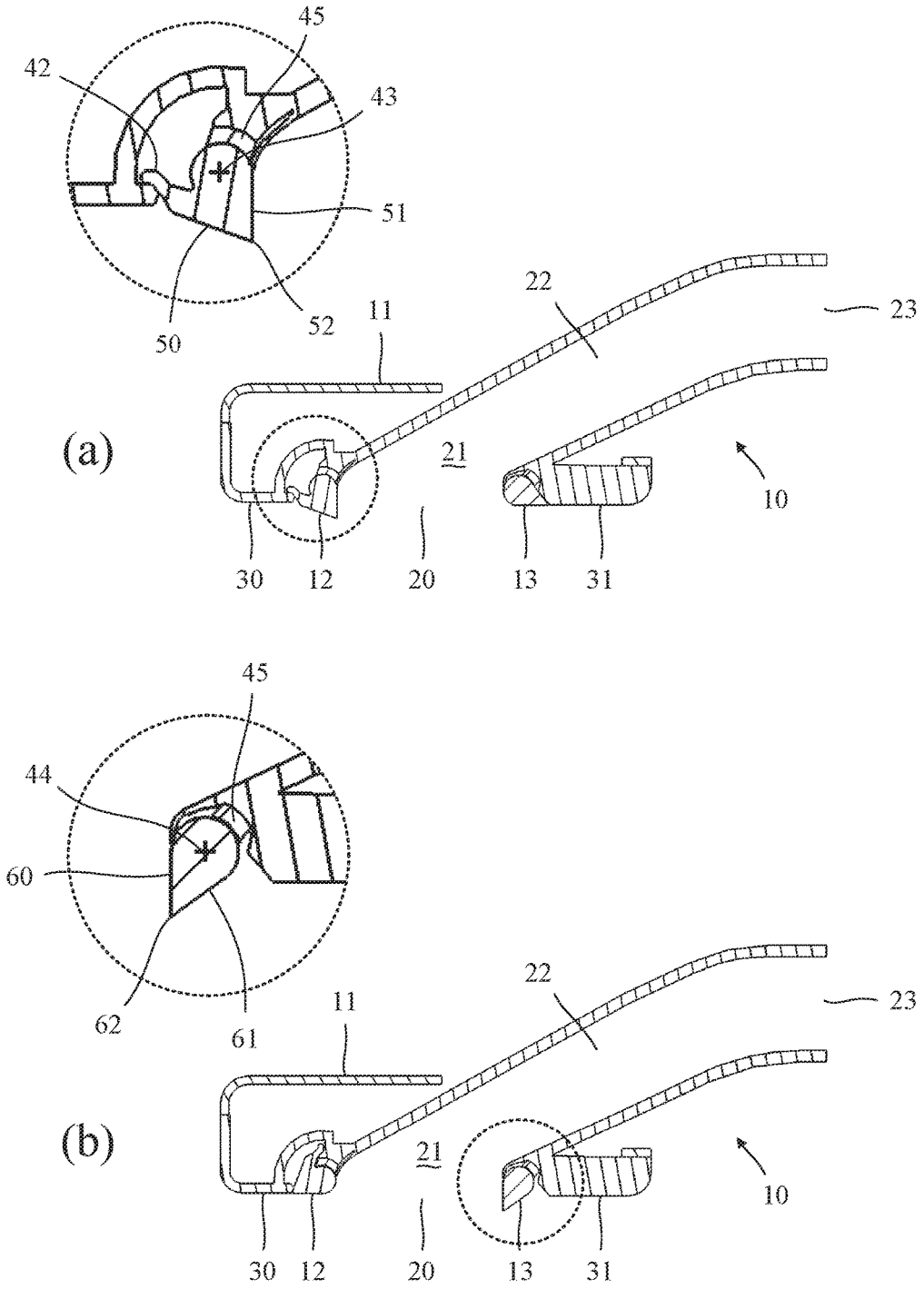
FIG. 7 is a sectional slice through the centre of the cleaner head of FIG. 4 in which blades of the cleaner head are in (a) a first configuration and (b) a second configuration.

Each blade 12,13 pivots between a deployed position and a retracted position. FIG. 7(*a*) illustrates the cleaner head 10 with (a) the front blade 12 in the deployed position and the rear blade 13 in the retracted position, and FIG. 7(*b*) illustrates the cleaner head 10 with the front blade 12 in the retracted position and the rear blade 13 in the deployed position. When in the deployed position, each blade 12,13 projects downwardly, which is to say that the triangular portion of the blade 12,13 is directed downwards. Moreover, the blade 12,13 projects downwardly beyond the base of the main body 11. So, for example, when the front blade 12 is in the deployed position, the blade 12 projects downwardly beyond the plane of the front plate 30. When in the deployed position, each blade 12,13 may be said to have a front-facing surface 50,60, a rear-facing surface 51,61, and a working edge 52,62 at the meeting of the two surfaces. The front-facing surface 50 of the front blade 12 and the rear-facing surface 61 of the rear blade 13 are ramped. More specifically, the front-facing surface 50 of the front blade 12 extends upwardly from the working edge 52 in a direction towards the front of the main body 11, and the rear-facing surface 61 of the rear blade 13 extends upwardly from the working edge 62 in a direction towards the rear of the main body 11. The rear-facing surface 51 of the front blade 12 and the front-facing surface 60 of the rear blade 13 extend vertically. When in the retracted position, each blade 12,13 projects forwards (front blade) or rearwards (rear blade), which is again to say that the triangular portion of the blade 12,13 is directed forwards or rearwards. Moreover, each blade 12,13 is flush with the base of the main body 11. So, for example, when the front blade 12 is in the retracted position, the rear-facing surface 51 of the front blade 12 lies in the same plane as that of the front plate 30.

The stop arm 42 of the front blade 12 contacts the main body 11 when the front blade 12 is both in the deployed position and the retracted position. The stop arm 42 thus prevents movement of the front blade 12 beyond these two positions. As noted below, the two blades 12,13 are coupled together and thus the stop arm 42 also acts to prevent movement of the rear blade 13 beyond the deployed and retracted positions.

The two blades 12,13 are coupled together such that (i) when one of the blades 12 is in the deployed position, the other of the blades 13 is in the retracted position, and (ii) when one of the blades 12 moves from the deployed position to the retracted position, the other of the blades 13 is caused to move from the retracted position to the deployed position. The blades 12,13 are coupled together by the two brackets 14. One of the brackets 14 is used to couple the blades 12,13 on one side of the main body 11, and the other of the brackets 14 is used to couple the blades 12,13 on the opposite side of the main body 11. Each bracket 14 comprises two arms 70,71 and a bridge 72. One arm 70 is fixedly attached at one end to a pivot pin 41 of the front blade 12, and is pivotally attached at the opposite end to the bridge 72. The other arm 71 is fixedly attached at one end to a pivot pin 41 of the rear blade 13, and is pivotally attached at the opposite end to the bridge 72. The bridge 72 then extends between and is pivotally attached to the two arms 70,71. When the front blade 12 moves from the deployed position to the retracted position, the arm 70 attached to the front blade 12 pivots about the first axis 43. The bridge 72 is then pushed rearwards by the arm 70, which in turn causes the other arm 71 to pivot about the second axis 44. As a result, the rear blade 13 moves from the retracted position to the deployed position. Similarly, when the rear blade 13 moves from the deployed position to the retracted position, the arm 71 attached to the rear blade 13 pivots about the second axis 44. The bridge 72 is then pushed forwards by the arm 71, which in turn causes the other arm 70 to pivot about the first axis 43. As a result, the front blade 12 moves from the retracted position to the deployed position.

The covers 15 are attached to the main body 11 so as to cover the brackets 14 and the ends of the blades 12,13.

Use of the cleaner head 10 on a carpeted surface 80 will now be described with reference to FIG. 8.

Figure 8:
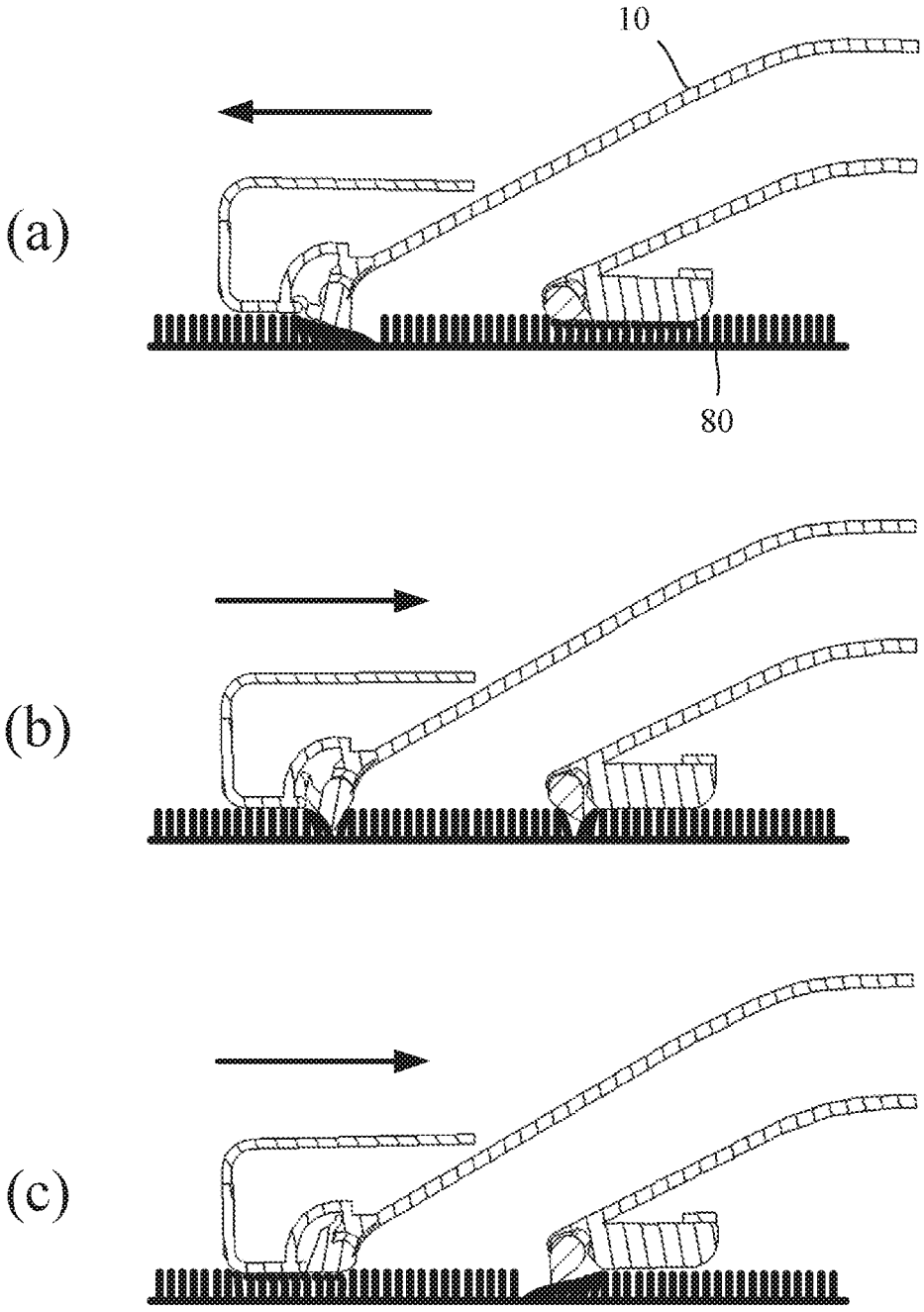
FIG. 8 a sectional slice through the centre of the cleaner head of FIG. 4 during use on a carpeted surface in which (a) illustrates the cleaner head during forward movement, (b) illustrates the cleaner head shortly after the direction of travel of the cleaner head has been reversed, and (c) illustrates the cleaner head during rearward movement.

FIG. 8(*a*) illustrates the cleaner head 10 when moving in a forward direction. The front blade 12 is in the deployed position and the rear blade 13 is in the retracted position. Suction generated at the suction outlet 23 causes air to be drawn into the suction cavity 21 via the suction inlet 20. The air that is drawn in at the front of the cleaner head 10 is forced to pass beneath the front blade 12. The front blade 12, being in the deployed position, penetrates deeply into the piles of the carpet 80. As a result, the air penetrates deeply into the carpet 80 and picks up more of the dirt. The rear blade 13 and the rear plate 31 present a planar surface that sits on top of and gently crushes the piles of the carpet 80. A partial seal is therefore created between the carpet 80 and that part of the cleaner head 10 located rearward of the suction inlet 20. As a result, less air is drawn in at the rear of the cleaner head 10 and thus more air is drawn in at the front of the cleaner head 10, where it is most desired during forward movement. As the cleaner head 10 moves forwards, the piles of the carpet 80 apply a force on the front blade 12 that acts in a rearward direction. However, the stop arm 42 prevents the front blade 12 from pivoting rearwards beyond the deployed position. The ramped, front-facing surface 50 of the front blade 12 deflects and flattens the piles of the carpet 80. The front blade 12 therefore moves relatively smoothly over the carpet 80. The rear blade 13 and the rear plate 31 continue to present a planar surface that sits on top of the carpet 80. As a result, movement of the cleaner head 10 is not unduly impeded by the rear blade 13 or the rear plate 31.

FIG. 8(*b*) illustrates the cleaner head 10 shortly the direction of travel of the cleaner head 10 has been reversed. When the direction of the cleaner head 10 is reversed and begins to moves rearwards, the piles of the carpet 80 apply a force on the front blade 12 that acts in a forward direction. As a result, the front blade 12 begins to move from the deployed position to the retracted position. Owing to the coupling between the two blades 12,13, the rear blade 13 also begins to move from the retracted position to the deployed position. As the rear blade 13 moves from the retracted position, the rear blade 13 catches on the piles of the carpet 80. Consequently, in addition to applying a force on the front blade 12, the piles of the carpet 80 apply a force on the rear blade 13. The carpet 80 therefore pushes the front blade 12 up to the retracted position and pulls the rear blade 13 down to the deployed position.

FIG. 8(*c*) illustrates the cleaner head 10 when moving in a rearward direction. The front blade 12 is now in the retracted position and the rear blade 13 is in the deployed position. The rear blade 13 penetrates deeply into the piles of the carpet 80. As a result, the air that is drawn in at the rear of the cleaner head 10 penetrates deeply into the carpet 80. The front blade 12 and the front plate 30 present a planar surface that sits on top of and gently crushes the piles of the carpet 80. A partial seal is therefore created between the carpet 80 and that part of the cleaner head 10 located forward of the suction inlet 20. As a result, less air is drawn in at the front of the cleaner head 10 and thus more air is drawn in at the rear of the cleaner head 10, where it is most desired during rearward movement. As the cleaner head 10 moves rearwards, the ramped, rear-facing surface 61 of the rear blade 13 deflects and flattens the piles of the carpet 80. The rear blade 13 therefore moves relatively smoothly over the carpet 80. The front blade 12 and the front plate 30 continue to present a planar surface that sits on top of the carpet 80. As a result, rearward movement of the cleaner head 10 is not unduly impeded by the front blade 12 or the front plate 30.

Figure 2:
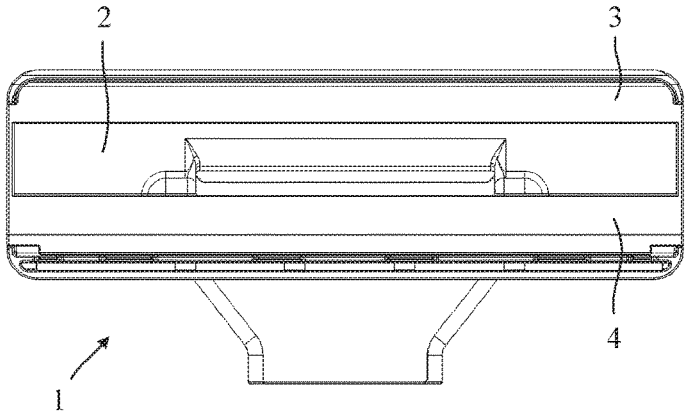
Fig. 2 (Prior Art)
FIG. 2 is an underside view of the cleaner head of FIG. 1.
Figure 3:
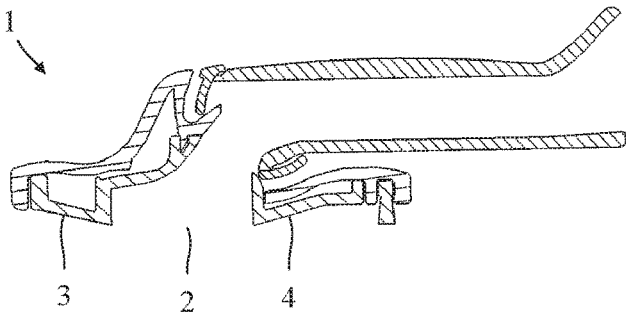
Fig. 3 (Prior Art)
FIG. 3 is a sectional slice through the centre of the cleaner head of FIG. 1.
Figure 4:
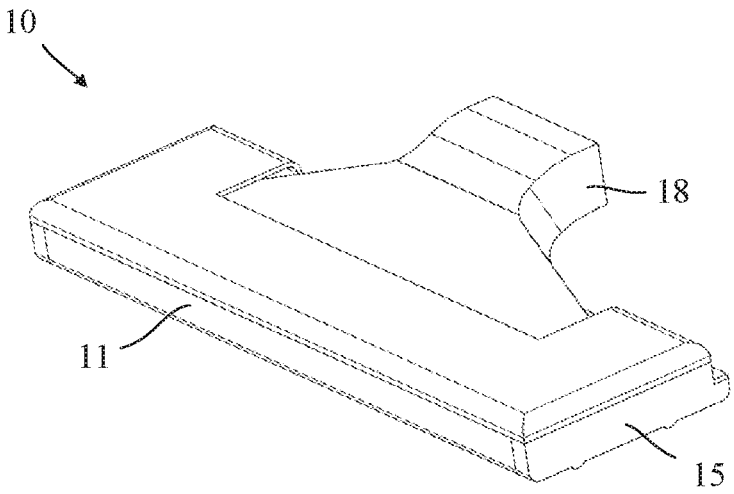
FIG. 4 is a perspective view of a cleaner head in accordance with the present invention.
Figure 5:
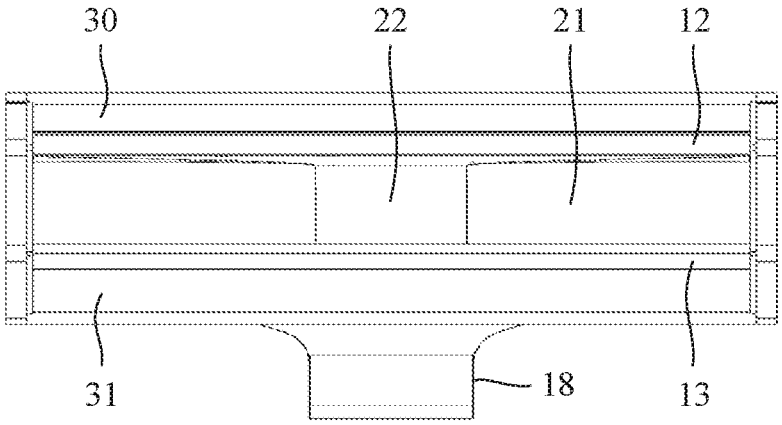
FIG. 5 is a underside view of the cleaner head of FIG. 4.
Figure 6:
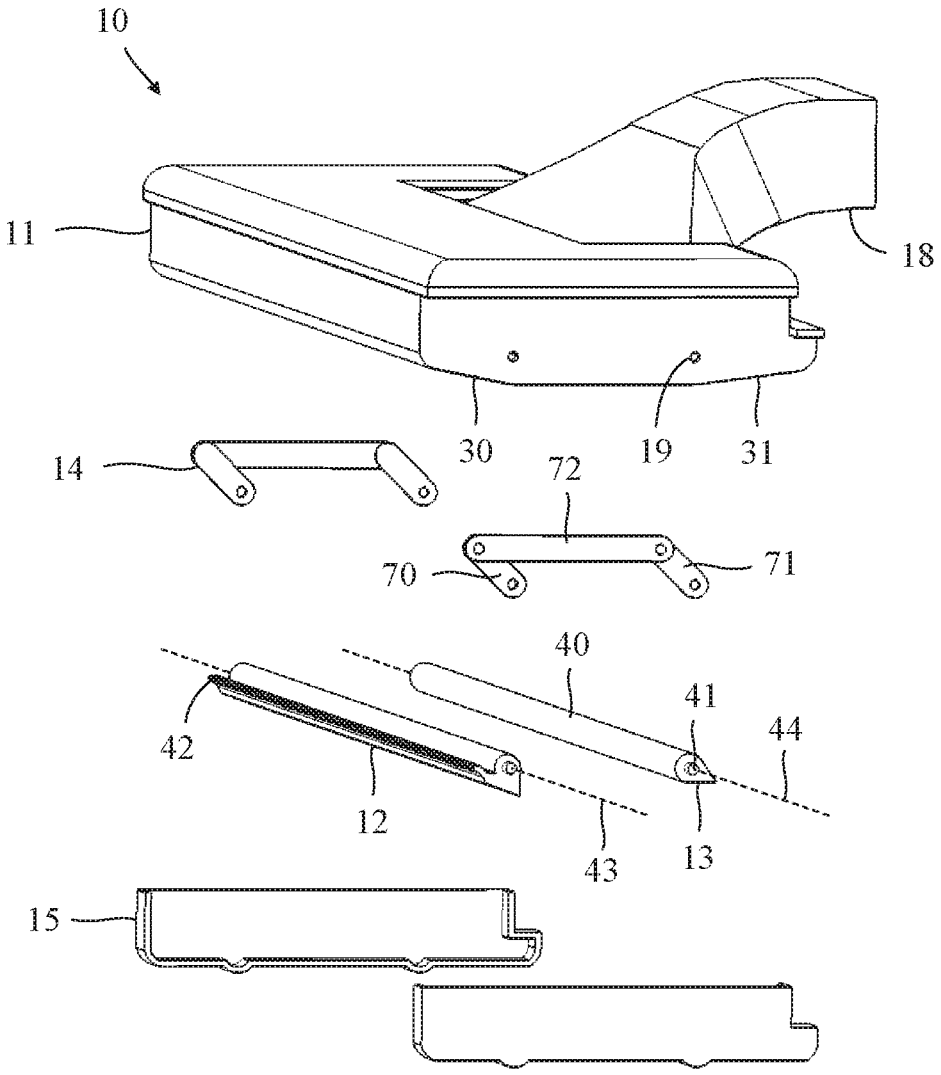
FIG. 6 is an exploded view of the cleaner head of FIG. 4.

In comparison to the cleaner head 1 of FIGS. 1 to 3, the cleaner head 10 described above and illustrated in FIGS. 4-8 is capable of achieving a better cleaning performance. In particular, when the cleaner head 10 is manoeuvred forwards, the front blade 12 penetrates the carpet 80 and a partial seal is created rearward of the suction inlet 20 between the cleaner head 10 and the carpet 80. As a consequence of the partial seal, more air is drawn beneath the front blade 12 and thus more dirt is carried by the air into the suction inlet 20. Similarly, when the cleaner head 10 is manoeuvred rearwards, the rear blade 13 penetrates the carpet 80 and a partial seal is created forward of the suction inlet 20 between the cleaner head 10 and the carpet 80. As a result, more air is drawn beneath the rear blade 13. With the cleaner head 1 of FIGS. 1 to 3, on the other hand, air is drawn equally beneath the front plate 3 and the rear plate 4 during both forward and rearward movement of the cleaner head 1. As a result, the air passing beneath each plate 3,4 has a lower flow rate and thus less dirt is carried by the air into the suction inlet 2.

In contrast to the cleaner head 1 of FIGS. 1 to 3, the cleaner head 10 described above is easier to manoeuvre and is less likely to skip over the carpeted surface 80. In particular, when the cleaner head 10 is manoeuvred forwards or rearwards, the trailing blade (i.e. the rear blade 13 during forward movement or the front blade 12 during rearward movement) moves to the retracted position and does not unduly impede movement of the cleaner head 10. By contrast, when the cleaner head 1 of FIGS. 1 to 3 is manoeuvred forwards or rearwards, the trailing plate 3 or 4 tends to dig into the piles of the carpet. As a result, a greater force is required to manoeuvre the cleaner head 10. Additionally, the cleaner head 1 is more likely to skip over the carpet as the trailing plate 3 or 4 digs into the piles and then, with sufficient force, jumps clear of the piles.

Since the trailing blade 12 or 13 moves to the retracted position and does not unduly impede movement of the cleaner head 10, it is possible to employ blades 12,13 that penetrate more deeply into the carpet 80. By contrast, if the plates 3,4 of the cleaner head 1 of FIGS. 1 to 3 were to penetrate more deeply into the carpet, the force required to manoeuvre the cleaner head 1 may become excessive and/or skipping of the cleaner head 1 may become frequent.

In embodiment described above, the front and rear blades 12,13 are located in the suction cavity 21. A seal 45 is then provided between each blade 12,13 and the main body 11 of the cleaner head 10. As a result, dirt-laden air is prevented from being drawn through the relatively tight space between the blades 12,13 and the main body 11. Since the blades 12,13 are located in the suction cavity 21, the blades 12,13 may be regarded as delimiting the front and rear edges of the effective suction inlet (i.e. that part of the suction inlet 20 through which air is drawn). The front blade 12 pivots forwards as it moves from the deployed position to the retracted position, and the rear blade 13 pivots rearwards. As a result, the size of the effective suction inlet is unchanged; this can be seen in FIGS. 7 and 8.

When in the deployed position, the rear-facing surface 51 of the front blade 12 and the front-facing surface 60 of the rear blade 13 extend vertically. As a result, a relatively sharp working edge 52,62 is achieved for each blade 12,13. This then has the benefit that a relatively poor seal is formed between the deployed blade 12 or 13 and the carpet 80. Consequently, more of the air that is drawn into the suction inlet 20 occurs at the deployed blade 12 or 13. Furthermore, as can be seen in FIGS. 8(*a*) and 8(*c*), the dirt-laden air drawn beneath the deployed blade 12 or 13 has a relatively clear path to the suction inlet 20 and thus dirt carried by the air is less likely to be deposited back onto the carpet 80.

Rather than locating the blades 12,13 in the suction cavity 21, the blades 12,13 may be located outside of the suction cavity 21. Accordingly, in a more general sense, the front blade 12 may be said to be located forward of or at the front of the suction inlet 20, and the rear blade 13 may be said to be located rearward of or at the rear of the suction inlet. Where the blades 12,13 are located outside of the suction cavity 21, the blades 12,13 are ideally located close to the suction inlet 20 such that a relatively short path is taken by the air as it moves from beneath the deployed blade 12 or 13 to the suction inlet 20. The reason for this is that, as the length of the path taken by the air increases, there is an increasing likelihood that dirt carried by the air may be deposited back onto the carpet 80.

Each blade 12,13 projects downwardly when in the deployed position and pivots through an angle of around 90 degrees when moving to the retracted position. As a result, the front blade 12 projects forward and the rear blade 13 projects rearward when in the retracted position. Moreover, each blade 12,13 is flush with the corresponding plate 30,31 when in the retracted position. This then has the advantage that each blade 12,13, when in the retracted position, contributes to the partial seal that is formed between the cleaner head 10 and the carpeted surface 80. In spite of this advantage, each blade 12,13 may pivot through a smaller or larger angle. A smaller angle would mean that each blade 12,13 continues to project downwardly to some degree when in the retracted position, whilst a larger angle would mean that each blade 12,13 projects upwardly. Irrespective of the angle through which the blades 12,13 pivot, each blade 12,13 nevertheless moves away from the deployed position. As a result, movement of the cleaner head 10 is easier in comparison to an arrangement in which both blades 12,13 are fixed in the deployed position.

The blades 12,13 of the cleaner head 10 move automatically between the deployed and retracted positions as the cleaner head 10 is manoeuvred forwards and rearwards. This then has the advantage that a user is not required to adjust the setting of the cleaner head 10 for forward or rearward movement. The two blades 12,13 are coupled together using a pair of brackets 14, which is a relatively simple arrangement for ensuring that, as one blade 12 moves from the deployed position to the retracted position, the other blade 13 moves from the retracted position to the deployed position. Conceivably alternative means may be used for coupling the two blades 12,13 together whilst achieving the same effect. Moreover, rather than coupling the two blades 12,13 together, each blade 12,13 may be configured for independent movement. However, in order to achieve the advantages described above, the two blades 12,13 should ideally be configured such that moving the cleaner head 10 in a forward direction causes the front blade 12 to move to the deployed position and the rear blade 13 to move to the retracted position, and moving the cleaner head 10 in a rearward direction causes the rear blade 13 to move to the deployed position and the front blade 12 to move to the retracted position.

The front plate 30 located forward of the front blade 12, and the rear plate 31 located rearward of the rear blade 13 have the advantage of providing a better seal between the cleaner head 1 and the carpeted surface 80. In particular, each plate 30,31 along with its corresponding retracted blade 12,13, gently crush and from a partial seal with the carpet 80. In spite of this advantage, the front and rear plates 30,31 may be omitted, ramped or located at a different height to the retracted blade 12,13.

The invention claimed is:

1. A cleaner head for a vacuum cleaner comprising:

a suction inlet;

a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, each blade projects downwardly when in the deployed position, and the blades are coupled together by at least one linkage such that (i) when one of the blades is in the deployed position the other of the blades is in the retracted position, and (ii) moving one of the blades from the deployed position to the retracted position causes movement of the at least one linkage that causes the other of the blades to move from the retracted position to the deployed position, and wherein, when a direction of travel of the cleaner head over a cleaning surface is reversed, the cleaning surface applies a force to the blade in the deployed position that causes the blade in the deployed position to move towards the retracted position.

2. The cleaner head of claim 1, wherein, when in the deployed position, the front blade has a ramped front-facing surface, and the rear blade has a ramped rear-facing surface.

3. The cleaner head of claim 1, wherein, when in the deployed position, the front blade has a vertical rear-facing surface, and the rear blade has a vertical front-facing surface.

4. The cleaner head of claim 1, wherein, when in the deployed position, each blade has a front-facing surface and a rear-facing surface, and, when in the retracted position, the rear-facing surface of the front blade and the front-facing surface of the rear blade are horizontal.

5. The cleaner head of claim 1, wherein the cleaner head comprises a planar front plate located forward of the front blade and a planar rear plate located rearward of the rear blade, the front blade projects downwardly beyond the front plate when in the deployed position, and the rear blade projects downwardly beyond the rear plate when in the deployed position.

6. The cleaner head of claim 5, wherein the front blade is flush with the front plate when in the retracted position, and the rear blade is flush with the rear plate when in the retracted position.

7. The cleaner head of claim 1, wherein the front blade moves to the deployed position when the cleaner head is manoeuvred forwards over a cleaning surface, and the rear blade moves to the deployed position when the cleaner head is manoeuvred rearwards over the cleaning surface.

8. The cleaner head of claim 1, wherein the front blade pivots forward and the rear blade pivots rearward when moving from the deployed position to the retracted position.

9. The cleaner head of claim 1, wherein the blades are coupled together by a bracket that is attached to each blade.

10. A cleaner head for a vacuum cleaner comprising:

a suction inlet;

a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, each blade projects downwardly when in the deployed position, and moving the cleaner head over a cleaning surface in a forward direction causes the cleaning surface to front blade to move to the deployed position and the rear blade to move to the retracted position, and moving the cleaner head over the cleaning surface in a rearward direction causes the rear blade to move to the deployed position and the front blade to move to the retracted position.

11. The cleaner head of claim 10, wherein the front blade pivots forward and the rear blade pivots rearward when moving from the deployed position to the retracted position.

12. The cleaner head of claim 10, wherein, when the direction of travel of the cleaner head over the cleaning surface is reversed, the cleaning surface applies a force to the blade in the deployed position that causes the blade to move towards the retracted position.

13. The cleaner head of claim 10, wherein, when in the deployed position, the front blade has a ramped front-facing surface, and the rear blade has a ramped rear-facing surface.

14. The cleaner head of claim 10, wherein, when in the deployed position, the front blade has a vertical rear-facing surface, and the rear blade has a vertical front-facing surface.

15. The cleaner head of claim 10, wherein, when in the deployed position, each blade has a front-facing surface and a rear-facing surface, and, when in the retracted position, the rear-facing surface of the front blade and the front-facing surface of the rear blade are horizontal.

16. The cleaner head of claim 10, wherein the cleaner head comprises a planar front plate located forward of the front blade and a planar rear plate located rearward of the rear blade, the front blade projects downwardly beyond the front plate when in the deployed position, and the rear blade projects downwardly beyond from the rear plate when in the deployed position.

17. The cleaner head of claim 16, wherein the front blade is flush with the front plate when in the retracted position, and the rear blade is flush with the rear plate when in the retracted position.

18. A cleaner head for a vacuum cleaner comprising:

a suction inlet;

a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, the blades are configured such that when one of the blades is in the deployed position the other of the blades is in the retracted position, and, when in the deployed position, the front blade has a ramped front-facing surface and the rear blade has a ramped rear-facing surface.

19. The cleaner head of claim 18, wherein, when in the deployed position, the front blade has a vertical rear-facing surface, and the rear blade has a vertical front-facing surface.

20. The cleaner head of claim 18, wherein, when in the deployed position, each blade has a rear-facing surface, and, when in the retracted position, the rear-facing surface of the front blade and the front-facing surface of the rear blade are horizontal.

21. The cleaner head of claim 18, wherein the cleaner head comprises a planar front plate located forward of the front blade and a planar rear plate located rearward of the rear blade, the front blade projects downwardly beyond the front plate when in the deployed position, and the rear blade projects downwardly beyond the rear plate when in the deployed position.

22. The cleaner head of claim 21, wherein the front blade is flush with the front plate when in the retracted position, and the rear blade is flush with the rear plate when in the retracted position.

23. The cleaner head of claim 18, wherein the front blade moves to the deployed position when the cleaner head is manoeuvred forwards of a cleaning surface, and the rear blade moves to the deployed position when the cleaner head is manoeuvred rearwards over the cleaning surface.

24. The cleaner head of claim 18, wherein, when the direction of travel of the cleaner head over a cleaning surface is reversed, the cleaning surface applies a force to the blade in the deployed position that causes the blade to move towards the retracted position.

25. The cleaner head of claim 18, wherein the front blade pivots forward and the rear blade pivots rearward when moving from the deployed position to the retracted position.

26. A cleaner head for a vacuum cleaner comprising:

a main body having a suction inlet located in a base of the main body;

a front blade located forward of or at the front of the suction inlet and arranged to pivot about a first axis; and a rear blade located rearward of or at the rear of the suction inlet and arranged to pivot about a second axis different to the first axis, wherein each blade pivots between a deployed position and a retracted position, the blades are configured such that when one of the blades is in the deployed position the other of the blades is in the retracted position, each blade projects downwardly beyond the base of the main body when in the deployed position, and each blade is flush with the base of the main body when in the retracted position, and wherein, when a direction of travel of the cleaner head over a cleaning surface is reversed, the cleaning surface applies a force to the blade in the deployed position that causes the blade in the deployed position to move towards the retracted position.

27. The cleaner head of claim 26, wherein, when in the deployed position, the front blade has a ramped front-facing surface, and the rear blade has a ramped rear-facing surface.

28. The cleaner head of claim 26, wherein, when in the deployed position, the front blade has a vertical rear-facing surface, and the rear blade has a vertical front-facing surface.

29. The cleaner head of claim 26, wherein the front blade moves to the deployed position when the cleaner head is manoeuvred forwards over a cleaning surface, and the rear blade moves to the deployed position when the cleaner head is manoeuvred rearwards over the cleaning surface.

30. The cleaner head of claim 26, wherein the front blade pivots forward and the rear blade pivots rearward when moving from the deployed position to the retracted position.

* * * * *